US009759465B2

(12) United States Patent
Schuster et al.

(10) Patent No.: US 9,759,465 B2
(45) Date of Patent: Sep. 12, 2017

(54) AIR CONDITIONER SELF-CHARGING AND CHARGE MONITORING SYSTEM

(71) Applicants: Don A. Schuster, Lindale, TX (US); Adeyemi A. Adepetu, Jamaica Plain, MA (US); Sathish R. Das, Indianapolis, IN (US); Rajendra K. Shah, Indianapolis, IN (US)

(72) Inventors: Don A. Schuster, Lindale, TX (US); Adeyemi A. Adepetu, Jamaica Plain, MA (US); Sathish R. Das, Indianapolis, IN (US); Rajendra K. Shah, Indianapolis, IN (US)

(73) Assignee: CARRIER CORPORATION, Farmington, CT (US)

( * ) Notice: Subject to any disclaimer, the term of this patent is extended or adjusted under 35 U.S.C. 154(b) by 851 days.

(21) Appl. No.: 13/723,519

(22) Filed: Dec. 21, 2012

(65) Prior Publication Data

US 2013/0160470 A1 Jun. 27, 2013

Related U.S. Application Data

(60) Provisional application No. 61/580,373, filed on Dec. 27, 2011.

(51) Int. Cl.
*F25B 45/00* (2006.01)

(52) U.S. Cl.
CPC ..... *F25B 45/00* (2013.01); *F25B 2345/001* (2013.01); *F25B 2345/002* (2013.01); *F25B 2500/19* (2013.01); *F25B 2700/04* (2013.01); *F25B 2700/151* (2013.01); *F25B 2700/195* (2013.01); *F25B 2700/1931* (2013.01); *F25B 2700/1933* (2013.01); *F25B 2700/21163* (2013.01)

(58) Field of Classification Search
CPC ..... F25B 45/00; F25B 2345/001; F25B 2345/002; F25B 2345/003; F25B 2500/23; F25B 2500/24
USPC ..... 62/77, 149
See application file for complete search history.

(56) References Cited

U.S. PATENT DOCUMENTS 3,826,104 A 7/1974 Lamb et al.
4,106,306 A 8/1978 Saunders
(Continued)

FOREIGN PATENT DOCUMENTS

EP 0271429 6/1988
EP 0159281 5/1990
(Continued)

OTHER PUBLICATIONS

International Search Report and Written Opinion for PCT/US06/48573 dated Nov. 19, 2007, 9 pages.

*Primary Examiner* — Cassey D Bauer
(74) *Attorney, Agent, or Firm* — Cantor Colburn LLP

(57) ABSTRACT

A method for determining a level of refrigerant charge in a vapor compression system having a compressor, a condenser, an expansion device and an evaporator operatively connected in serial relationship in a refrigerant flow circuit having a refrigerant, includes receiving information indicative of at least one of a compressor torque or compressor current; and determining whether the refrigerant charge is within a defined tolerance or whether the refrigerant is to be added or recovered in response to the receiving of the information.

30 Claims, 3 Drawing Sheets

(56) References Cited

U.S. PATENT DOCUMENTS 4,114,448 A 9/1978 Merritt
4,304,126 A 12/1981 Yelke
4,325,223 A 4/1982 Cantley
4,381,549 A 4/1983 Stamp, Jr. et al.
4,429,578 A 2/1984 Darrel et al.
4,470,265 A 9/1984 Correia
4,484,452 A 11/1984 Houser, Jr.
4,510,576 A 4/1985 MacArthur et al.
4,513,578 A 4/1985 Proctor et al.
4,541,284 A 9/1985 Guagliumi et al.
4,546,616 A 10/1985 Drucker
4,561,261 A 12/1985 Kornrumpf et al.
4,624,112 A 11/1986 Proctor
RE32,451 E 7/1987 Proctor et al.
4,677,830 A 7/1987 Sumikawa et al.
4,688,388 A 8/1987 Lower et al.
4,745,519 A 5/1988 Breidegam
4,755,957 A 7/1988 White et al.
4,776,175 A 10/1988 Romijn
4,798,055 A 1/1989 Murray et al.
4,805,416 A 2/1989 Manz et al.
4,829,777 A 5/1989 Matsuoka et al.
4,841,734 A 6/1989 Torrence
4,856,288 A 8/1989 Weber
4,982,576 A 1/1991 Proctor et al.
5,016,472 A 5/1991 Amrhein et al.
5,046,322 A 9/1991 Bulla et al.
5,057,965 A 10/1991 Wilson
5,079,930 A 1/1992 Beaverson et al.
5,097,667 A 3/1992 Gramkow
5,140,827 A 8/1992 Reedy
5,156,012 A 10/1992 Kuribara et al.
5,172,562 A 12/1992 Manz et al.
5,186,012 A 2/1993 Czachorski et al.
5,206,963 A 5/1993 Wiens
5,214,918 A 6/1993 Oguni et al.
5,228,304 A 7/1993 Ryan
5,231,841 A 8/1993 McClelland et al.
5,235,821 A 8/1993 Sevrain et al.
5,239,865 A 8/1993 Salzer et al.
H1226 H 9/1993 VanReenen et al.
5,241,833 A 9/1993 Ohkoshi
5,246,045 A 9/1993 Clothier et al.
5,248,168 A 9/1993 Chichester et al.
5,249,434 A 10/1993 Abraham
5,251,453 A 10/1993 Stanke et al.
5,261,249 A 11/1993 Manz et al.
5,285,647 A 2/1994 Manz et al.
5,295,360 A 3/1994 Olds et al.
5,317,903 A 6/1994 McClelland et al.
5,339,642 A 8/1994 Laukhuf
5,341,649 A 8/1994 Nevitt et al.
5,354,103 A 10/1994 Torrence et al.
5,362,530 A 11/1994 Kitami et al.
5,374,084 A 12/1994 Potokar
5,381,669 A 1/1995 Bahel et al.
5,406,806 A 4/1995 Ricketts et al.
5,406,980 A 4/1995 Allread et al.
5,413,147 A 5/1995 Moreiras et al.
5,423,189 A 6/1995 Nicol et al.
5,425,558 A 6/1995 Dennany, Jr.
5,430,692 A 7/1995 Grupp et al.
5,463,377 A 10/1995 Kronberg
5,464,042 A 11/1995 Haunhorst
5,468,028 A 11/1995 Olson
5,474,336 A 12/1995 Hoff et al.
5,540,463 A 7/1996 Potokar
5,586,445 A 12/1996 Bessler
5,694,778 A 12/1997 Wilson
5,752,726 A 5/1998 Fixemer
5,758,506 A 6/1998 Hancock et al.
5,775,112 A 7/1998 Wilson
5,802,860 A * 9/1998 Barrows ..... 62/126
5,807,332 A 9/1998 Augustine et al.
5,834,943 A 11/1998 Miller
5,860,286 A 1/1999 Tulpule
5,868,437 A 2/1999 Teague
5,961,157 A 10/1999 Baron et al.
5,987,903 A 11/1999 Bathla
6,012,743 A 1/2000 Godeau et al.
6,016,661 A 1/2000 Sagar
6,045,742 A 4/2000 McGrevy
6,101,820 A 8/2000 Cheballah
6,134,899 A 10/2000 Brown et al.
6,155,612 A 12/2000 Szabo
6,161,394 A 12/2000 Alsenz
6,179,214 B1 1/2001 Key et al.
6,209,338 B1 4/2001 Thatcher, Jr.
6,302,654 B1 10/2001 Millet et al.
6,308,523 B1 10/2001 Scaringe
6,318,097 B1 11/2001 Wieszt
6,324,854 B1 12/2001 Jayanth
6,330,802 B1 12/2001 Cummings et al.
6,354,332 B1 3/2002 Burkhardt et al.
6,382,678 B1 5/2002 Field et al.
6,427,457 B1 8/2002 Pfefferle et al.
6,442,953 B1 9/2002 Trigiani et al.
6,446,505 B1 9/2002 Wieszt et al.
6,460,354 B2 10/2002 Yabuki et al.
6,463,747 B1 10/2002 Temple
6,470,695 B2 10/2002 Gong
6,481,756 B1 11/2002 Field et al.
6,497,435 B1 12/2002 Luft et al.
6,505,475 B1 1/2003 Zugibe et al.
6,546,823 B1 4/2003 Veit
6,550,341 B2 4/2003 van Schoor et al.
6,553,774 B1 4/2003 Ishio et al.
6,571,566 B1 6/2003 Temple et al.
6,594,554 B1 7/2003 Seem et al.
6,658,373 B2 12/2003 Rossi et al.
6,708,508 B2 3/2004 Demuth et al.
6,735,964 B2 5/2004 Palmer et al.
6,758,051 B2 7/2004 Jayanth et al.
6,769,258 B2 8/2004 Pierson
6,843,070 B1 1/2005 Suharno
6,868,678 B2 3/2005 Mei et al.
6,925,821 B2 8/2005 Sienel
6,964,173 B2 11/2005 Dobmeier et al.
6,973,794 B2 12/2005 Street et al.
6,981,384 B2 1/2006 Dobmeier et al.
7,010,927 B2 3/2006 Lifson et al.
7,079,967 B2 7/2006 Rossi et al.
7,086,237 B2 8/2006 Arshansky et al.
7,104,075 B2 9/2006 Meeker
7,146,290 B2 12/2006 Triginai et al.
7,146,819 B2 12/2006 Demuth et al.
7,213,407 B2 5/2007 Hu
7,270,278 B2 9/2007 Street et al.
7,454,917 B2 11/2008 Nadamoto et al.
7,472,557 B2 * 1/2009 Kang et al. ..... 62/147
7,832,222 B2 11/2010 McMasters
7,946,121 B2 5/2011 Yamaguchi et al.
2002/0024218 A1 2/2002 Manuli
2002/0096209 A1 7/2002 Danielson et al.
2002/0121100 A1 9/2002 Yabuki et al.
2002/0139128 A1 10/2002 Suzuki et al.
2002/0141877 A1 10/2002 Jayanth et al.
2002/0182005 A1 12/2002 Milhas
2003/0089119 A1 5/2003 Pham et al.
2003/0172665 A1 9/2003 Matsuoka et al.
2003/0182950 A1 10/2003 Mei et al.
2003/0226367 A1 12/2003 Palmer et al.
2004/0022764 A1 2/2004 Polansky
2005/0235755 A1 10/2005 Hindman
2006/0042276 A1 * 3/2006 Doll et al. ..... 62/129
2006/0225451 A1 10/2006 Hu
2007/0022764 A1 2/2007 Hildebrand et al.
2007/0266717 A1 11/2007 Goodremote et al.
2009/0000315 A1 * 1/2009 Billman et al. ..... 62/73
2009/0013702 A1 1/2009 Murakami et al.
2009/0025406 A1 * 1/2009 Yoshimi ..... F24F 11/008 62/127
2009/0044550 A1 2/2009 Nishimura et al.
2009/0071175 A1 * 3/2009 Pham ..... 62/129

(56) References Cited

U.S. PATENT DOCUMENTS

| | | | | |
|---|---|---|---|---|
| 2009/0094998 | A1* | 4/2009 | McSweeney | F25B 49/005 62/129 |
| 2009/0100849 | A1 | 4/2009 | Nishimura et al. | |
| 2009/0114309 | A1 | 5/2009 | Sakai et al. | |
| 2009/0126375 | A1 | 5/2009 | Toyoshima et al. | |
| 2009/0235675 | A1 | 9/2009 | Chang et al. | |
| 2009/0314017 | A1* | 12/2009 | Nishimura et al. | 62/149 |
| 2010/0088046 | A1* | 4/2010 | Schuster et al. | 702/50 |
| 2010/0089076 | A1 | 4/2010 | Schuster et al. | |
| 2010/0101246 | A1 | 4/2010 | Douglas et al. | |
| 2010/0281890 | A1 | 11/2010 | Govekar et al. | |
| 2011/0061407 | A1 | 3/2011 | McMasters | |

FOREIGN PATENT DOCUMENTS

| | | | |
|---|---|---|---|
| EP | 0308160 | | 6/1991 |
| EP | 0453302 | | 10/1991 |
| EP | 0289369 | | 1/1992 |
| EP | 0396029 | | 9/1992 |
| EP | 0529758 | | 3/1993 |
| EP | 0550263 | | 7/1993 |
| EP | 0409000 | | 2/1994 |
| EP | 0843794 | | 5/1998 |
| EP | 0918182 | | 5/1999 |
| EP | 0760069 | | 6/2002 |
| EP | 1238838 | | 9/2002 |
| EP | 1337825 | | 8/2003 |
| EP | 1978254 | A1 * | 10/2008 |
| FR | 2667570 | | 4/1992 |
| GB | 2274695 | | 8/1994 |
| JP | 62218748 | | 9/1987 |
| JP | 62261845 | | 11/1987 |
| JP | 63302238 | | 12/1988 |
| JP | 02110268 | | 4/1990 |
| JP | 02195165 | | 8/1990 |
| JP | 04055671 | | 2/1992 |
| JP | 04190062 | | 7/1992 |
| JP | 04273941 | | 9/1992 |
| JP | 05099475 | | 4/1993 |
| JP | 05231754 | | 9/1993 |
| JP | 5256543 | | 10/1993 |
| JP | 755299 | | 3/1995 |
| JP | 08068576 | | 3/1996 |
| JP | 08261542 | | 10/1996 |
| JP | 08261543 | | 10/1996 |
| JP | 2000009048 | | 1/2000 |
| JP | 2000154954 | | 6/2000 |
| JP | 2001032884 | | 2/2001 |
| JP | 2001141279 | | 5/2001 |
| JP | 3141456 | | 4/2008 |
| JP | 2010002090 | A * | 1/2010 |
| KR | 20010029018 | | 4/2001 |
| KR | 20060121054 | | 11/2006 |
| WO | WO9320376 | | 10/1993 |
| WO | WO9530106 | | 11/1995 |
| WO | WO9530107 | | 11/1995 |
| WO | WO9533157 | | 12/1995 |
| WO | WO9617202 | | 6/1996 |
| WO | WO9712167 | | 4/1997 |
| WO | WO9713994 | | 4/1997 |
| WO | WO9713995 | | 4/1997 |
| WO | WO9747908 | | 12/1997 |
| WO | WO0045053 | | 8/2000 |
| WO | WO0123794 | | 4/2001 |
| WO | WO2004076943 | | 9/2004 |

* cited by examiner

AIR CONDITIONER SELF-CHARGING AND CHARGE MONITORING SYSTEM

CROSS REFERENCE TO RELATED APPLICATIONS

This applications claims the benefit of U.S. provisional patent application Ser. No. 61/580,373 filed Dec. 27, 2011, the entire contents of which are incorporated herein by reference in their entirety.

FIELD OF INVENTION

This invention relates generally to refrigerant vapor compression systems for residential or light commercial air conditioning applications and, more particularly, to a method and system for self-charging and monitoring the refrigerant charge in such system.

DESCRIPTION OF RELATED ART

Maintaining a proper refrigerant charge level is essential to the safe and efficient operation of an air conditioning system. Improper charge level, either in deficit or in excess, can cause a reduced system energy efficiency and premature compressor failure in some cases. An excess charge in the system results in compressor flooding which, in turn, may be damaging to the motor and mechanical components. Inadequate or a deficit refrigerant charge can lead to reduced system capacity, thus reducing system efficiency. A deficit charge also causes an increase in refrigerant temperature entering the compressor, which may cause thermal overload of the compressor. Thermal overload of the compressor can cause degradation of the motor winding insulation, thereby bringing about premature motor failure. Thermal overload may also cause overheating and damage the pumping elements.

Charge adequacy has traditionally been checked manually by trained service technicians using pressure gauges, temperature measurements, and a pressure-to-refrigerant temperature relationship chart for the particular refrigerant resident in the system. For refrigerant vapor compression systems which use a thermal expansion valve (TXV) or an electronic expansion valve (EXV), the expansion valve component regulates the superheat of the refrigerant leaving the evaporator at a fixed value, while the amount of subcooling of the refrigerant exiting the condenser varies depending on the total system refrigerant charge (i.e. charge level). Consequently, in such systems, the "subcooling method" is customarily used as an indicator for charge level. In this method, the amount of subcooling, defined as the saturated refrigerant temperature at the refrigerant pressure at the outlet of the condenser coil for the refrigerant in use, also called the refrigerant condensing temperature, minus the actual refrigerant temperature measured at the outlet of the condenser coil, is determined and compared to a range of acceptance levels of subcooling. For example, a subcool temperature range between 10 and 15 degree Fahrenheit is generally regarded as acceptable in a refrigerant vapor compression system operating as a residential or light commercial air conditioner.

In general during the charging process, the technician measures the refrigerant pressure at the condenser outlet and the refrigerant line temperature at a point downstream with respect to refrigerant flow of the condenser coil and upstream with respect to refrigerant flow of the expansion valve, generally at the outlet of the condenser. With these refrigerant pressure and temperature measurements, the technician then refers to the pressure to temperature relationship chart for the refrigerant in use to determine the saturated refrigerant temperature at the measured pressure and calculates the amount of subcooling actually present at the current operating conditions, which is outdoor temperature, indoor temperature, humidity, indoor airflow and the like. If the measured amount of subcooling lies within the range of acceptable levels, the technician considers the system properly charged. If not, the technician will adjust the refrigerant charge by either adding a quantity of refrigerant to the system or removing a quantity of refrigerant from the system, as appropriate.

As operating conditions may vary widely from day to day, the particular amount of subcooling measured by the field service technician at any given time may not truly reflect the amount of subcooling present during "normal" operation of the system. As a result, this charging procedure is also an empirical, time-consuming, and a trial-and-error process subject to human error. Therefore, the technician may charge the system with an amount of refrigerant that is not the optimal amount charge for "normal" operating conditions, but rather with an amount of refrigerant that is merely within an acceptable tolerance of the optimal amount of charge under the operating conditions at the time the system is charged.

BRIEF SUMMARY

According to one aspect of the invention, a method for determining a level of refrigerant charge in a vapor compression system having a compressor, a condenser, an expansion device and an evaporator operatively connected in serial relationship in a refrigerant flow circuit having a refrigerant, includes receiving information indicative of at least one of a compressor torque or compressor current; and determining whether the refrigerant charge is within a defined tolerance or whether the refrigerant is to be added or recovered in response to the receiving of the information.

According to another aspect of the invention, a method for determining a level of refrigerant charge in a vapor compression system having a compressor, a condenser coil, an expansion device and an evaporator coil connected in serial relationship in a refrigerant flow circuit having the refrigerant charge, includes controlling at least one system variable for the vapor compression system; receiving information indicative of a compressor torque or a compressor current; and determining the discharge pressure as a function of the received information; determining in real-time a value for a degree of refrigerant subcooling; and comparing the value for the degree of refrigerant subcooling with a target degree of refrigerant subcooling; outputting an electrical signal indicative of the real-time value for the degree of refrigerant subcooling present; and outputting the level of the refrigerant charge for the preselected time period of system operation.

Other aspects, features, and techniques of the invention will become more apparent from the following description taken in conjunction with the drawings.

BRIEF DESCRIPTION OF THE SEVERAL VIEWS OF THE DRAWINGS

Referring now to the drawings wherein like elements are numbered alike in the FIGURES.

DETAILED DESCRIPTION

Embodiments of a refrigerant vapor compression air conditioning system having self-charging and charge monitoring modes includes a controller operably connected to the system in order to facilitate refrigerant charging in a "self-charging" mode and to continuously monitor the refrigerant charge in a "charge monitoring" mode. In embodiments, the refrigerant subcooling is utilized for the self-charging and charge monitoring modes for the system utilizing either a variable speed compressor or a single speed non-variable speed compressor. In an embodiment, refrigerant subcooling is utilized to monitor the charge utilizing liquid line subcooling or system subcooling. Additional embodiments utilize compressor torque to predict discharge pressure using a map to the discharge pressure and subsequently to the saturated refrigerant temperature and liquid line temperature to obtain system subcooling or alternately from actual liquid line pressure or discharge line pressure from a dedicated pressure transducer located at either one of these locations and temperature from a liquid line temperature sensor to obtain liquid line subcooling. In the charging, self-charging, and charge monitoring modes, one or more parameters are fixed during the refrigerant charge in order to obtain consistent measurements from the system such as, for example, operating mode, compressor speed, indoor fan speed, and outdoor fan speed when measuring the subcooling in the system. Additionally, the self-charging mode includes charging the system when environmental conditions are within prescribed ranges while the charge-monitoring mode includes presetting operating parameters to obtain consistent charge measurements. These environmental conditions include, in embodiments, outdoor ambient temperature, indoor ambient temperature, indoor humidity, and moisture on the outdoor coil due to precipitation.

Figure 1:
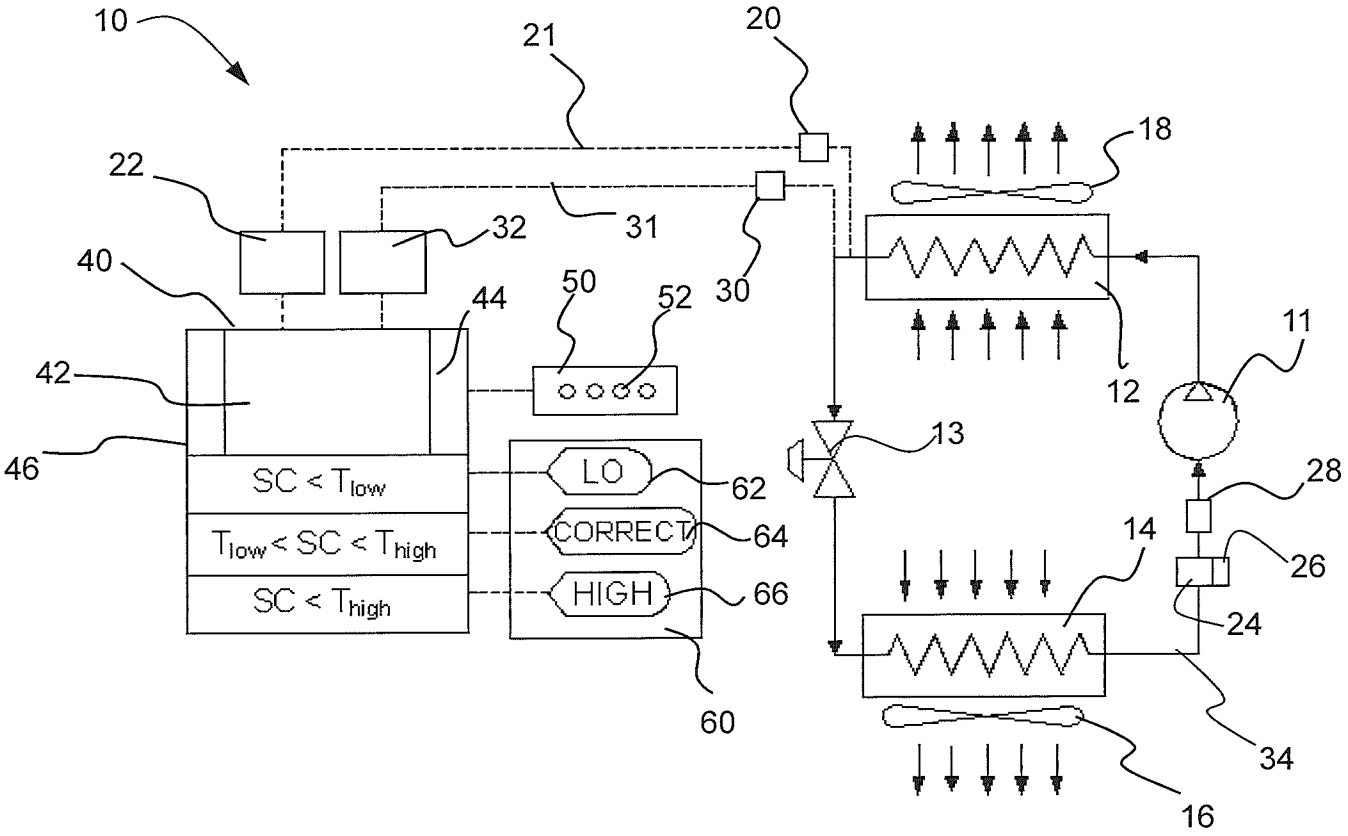
FIG. 1 illustrates a schematic view of an air-conditioning system including a controller and a variable speed compressor for implementing the self-charging and charge monitoring modes according to an embodiment of the invention.

Referring now to FIG. 1, there is shown an example of a refrigerant vapor compression air conditioning system 10 including a variable speed compressor 11 and a controller 40 for implementing the self-charging and charge monitoring modes of operation according to an embodiment of the invention. Particularly, the system 10 includes the variable speed compressor 11 driven by a variable speed motor 24 and controlled by an inverter drive 26, a condenser 12, an expansion device 13 and an evaporator 14 connected in serial relationship in refrigerant flow communication in a conventional manner via refrigerant line 34 forming a refrigerant flow circuit. In operation, the refrigerant, for example R12, R22, R134a, R404A, R410A, R407C, R717, R744 or other compressible fluid, circulating through the refrigerant circuit passes through an evaporator coil in the evaporator 14 in heat exchange relationship with indoor air being passed over the evaporator 14 by the evaporator fan 16. As the indoor air passes through the evaporator 14 and over the evaporator coil, the refrigerant absorbs the heat in the indoor air passing over the evaporator coil of evaporator 14, thereby cooling the air and evaporating the refrigerant. The cooled air is circulated by the evaporator fan 16 back into the indoor area to be cooled.

After evaporation, the refrigerant vapor is drawn through the refrigerant circuit back to the compressor 11 wherein the refrigerant vapor is pressurized. The resulting hot, high-pressure vapor is circulated through the refrigerant circuit to the condenser 12 wherein it passes through a condenser coil in heat exchange relationship with ambient temperature outdoor air being passed over the condenser coil by the condenser fan 18. As the outdoor air passes through the condenser 12 over the condenser coil, the refrigerant rejects heat to the outdoor air passing over the condenser coil, thereby heating the air and condensing the high pressure refrigerant vapor to a high pressure liquid refrigerant. The high pressure liquid refrigerant leaving the condenser 12 passes on through the refrigerant circuit traversing the expansion valve 13 wherein the high pressure refrigerant liquid is expanded to a lower temperature, lower pressure liquid, typically to a saturated liquid refrigerant before it enters the evaporator 14. It is to be appreciated that the expansion device 13 may be a valve such as a thermostatic expansion valve (TXV) or an electronic expansion valve (EXV), which regulates the amount of liquid refrigerant entering the evaporator 14 in response to the superheat condition of the refrigerant entering the compressor 11. It is also to be appreciated that the invention is equally applicable for use in association with other refrigerant vapor compression systems such as heat pump systems, both reversible and nonreversible. In a heat pump, during cooling mode, the process is identical to that as described hereinabove. In the heating mode, the cycle is reversed with the condenser and evaporator of the cooling mode acting as an evaporator and condenser, respectively.

Also shown, pressure sensor 28 and temperature sensor 30 are operably connected to the refrigerant line 34 in order to determine variables for refrigerant subcooling that are needed during the charging, self-charging, and charge monitoring modes in the vapor compression system 10. Alternately, a pressure sensor 20, and temperature sensor 30 are operably connected to the refrigerant line 34 in order to determine variables for refrigerant subcooling that are needed during the charging, self-charging, and charge monitoring modes in the vapor compression system 10. In embodiments, the refrigerant subcooling may be determined from the liquid line subcooling or system subcooling using system variables such as, for example, compressor torque, discharge pressure $P_{Discharge}$, suction pressure $P_{Suction}$ in order to determine the refrigerant subcooling and the refrigerant charge in the system 10. The liquid line subcooling uses the pressure sensor 20, which is operatively connected with the refrigerant circuit to measure the refrigerant liquid line pressure, $P_{Liquid}$, in the refrigerant circuit at or closely downstream with respect to refrigerant flow of the outlet of the condenser 12, and a temperature sensor 30, which is operatively connected with the refrigerant circuit to measure the refrigerant liquid temperature, $T_{liquid}$ that is downstream with respect to refrigerant flow of the outlet of the condenser 12 and upstream with respect to refrigerant flow of the expansion valve 13. Additionally, the system subcooling is calculated using the discharge pressure $P_{Discharge}$, which is calculated from the compressor torque, using a signal from pressure sensor 28 that provides the suction pressure $P_{Suction}$ and a temperature sensor 30 is operatively connected with the refrigerant circuit to measure the refrigerant liquid line temperature, $T_{liquid}$. It is to be appreciated that temperature sensor 30 may be a conventional temperature sensor such as, for example, a thermocouple, a thermistor, or similar device that is mounted on the refrigerant line through which the refrigerant is circulating. It is also to be appreciated that the temperature sensor 30 may also provide the defrost temperature for controlling the defrosting the coil on the evaporator 14, thereby eliminating an additional temperature sensor necessary for providing the defrost temperature on the refrigerant line 34.

Also shown in FIG. 1, the controller 40 includes a memory device 46 for storing signals from sensor 28, and 30 as well as data related to compressor torque in estimating compressor discharge pressure $P_{Discharge}$ and calculating the system subcooling. Alternatively, the controller 40 is operably connected to pressure sensor 20 and receives an analog voltage on communication line 21 by an analog-to-digital converter 22 indicative of the measured refrigerant liquid line pressure, $P_{Liquid}$ and stored signal from temperature sensor 30 indicative of the refrigerant liquid line temperature $T_{Liquid}$ in order to calculate the liquid line subcooling. Controller 40 includes a preprogrammed microprocessor 42 for executing instructions necessary for performing algorithms to map $P_{Discharge}$ from suction pressure $P_{Suction}$, compressor torque, and compressor speed. In an embodiment, discharge pressure $P_{Discharge}$ may be obtained from the motor torque of the variable speed compressor 11 or from the compressor torque from a torque transducer (not shown) that is subsequently used to map to the discharge pressure $P_{Discharge}$ via an algorithm in controller 40. Further, the temperature sensor 30 generates and sends an analog voltage signal on communication line 31 to the analog-to-digital converter 32 indicative of the measured refrigerant liquid temperature, $T_{Liquid}$. In calculating the system subcooling, the analog-to-digital converter 22 converts the analog signal received from the pressure sensor 28 into digital signal and stores the resulting digital signal indicative of the respective measured or calculated refrigerant discharge pressure $P_{Discharge}$ in the controller 40. Similarly, the analog-to-digital converter 32 converts the analog signal received from the temperature sensor 30 into a digital signal and stores that digital signal indicative of the measured refrigerant liquid temperature $T_{Liquid}$ in the controller 40. Alternatively, in order to calculate the liquid line subcooling, the analog-to-digital converter 22 converts the analog signal received from the pressure sensor 20 into digital signal and stores the resulting digital signal indicative of the respective measured liquid pressure $P_{Liquid}$ and the analog-to-digital converter 32 converts the analog signal received from the temperature sensor 30 into a digital signal and stores that digital signal indicative of the measured refrigerant liquid temperature $T_{Liquid}$ in the controller 40. The controller 40 may be a suitable programmable controller or application specific integrated circuit with stored programming for processing by a microprocessor 42 to calculate the refrigerant subcooling during the charging mode or to monitor the refrigerant charge in the system.

A subcooling target (SYSSCTARG) value or a range for a given system 10 is utilized for comparison of the calculated system charge, in order to determine if the charge in the system 10 at any given time is adequate. Parameters that influence the subcooling target are, in some non-limiting examples, indoor coil size, indoor relative humidity (RH), indoor temperature, indoor air flow in cubic feet per minute (CFM), lineset length, outdoor temperature, outdoor fan revolutions per minute (RPM), and compressor RPM. For this reason, the microprocessor 42 will calculate a target subcooling number for that given combination of operational parameters and system configuration parameters. For simplicity, outdoor fan speed, compressor speed and indoor CFM can be fixed at the same time, and minimally influencing parameters may be ignored or limited. For illustration purposes, one such formula using the lineset length, indoor coil size, and outdoor coil temperature parameters has the following relationship:

$$SYSSCTARG=t1*(CoilTemp2)+t2*Coil\ Temp+t3*(Coil\ Temp*Lineset\ length)+t4*Lineset\ length+b+c2$$

where c2 is the indoor coil size parameter; and t1, t2, t3, t4 and b are constants for a particular outdoor unit.

In an embodiment, the microprocessor 42 is programmed to calculate the saturated discharge temperature $T_{Dsat}$ from the discharge pressure $P_{Discharge}$ by mapping values of $P_{Discharge}$ to $T_{Dsat}$. The memory device 46 may be a ROM, an EPROM or other suitable data storage device. The memory device 46 is preprogrammed with the pressure to temperature relationship charts characteristic of at least the refrigerant in use in the system 10. The microprocessor 42 uses the saturated liquid temperature $L_{Lsat}$ or saturated discharge temperature, $T_{Dsat}$. Knowing the saturated liquid temperature $L_{Lsat}$ or saturated discharge temperature $T_{Dsat}$, and the liquid line temperature $T_{Liquid}$, the microprocessor 42 calculates the actual degrees of liquid line subcooling LSC or actual degrees of system subcooling SSC using equations (1) and (2) and stores the actual degrees of system subcooling or alternately liquid line subcooling in the memory device 46. Additionally, the controller 40 communicates with a service panel 50 for providing real-time output to a service technician during the refrigerant self-charging mode and for providing stored actual values of degrees of subcooling over a selected period of time during the charge-monitoring mode utilizing the calculated values of system subcooling SSC or alternately, liquid line subcooling LSC as is shown below.

$$SSC=T_{Dsat}-T_{Liquid} \quad (1)$$

$$LSC=T_{Lsat}-T_{Liquid}; \quad (2)$$

In operation, the controller 40 communicates with a service panel 50 or a service tool (not shown) for providing real-time output of the degrees of refrigerant subcooling to a service technician during the refrigerant self-charging mode and for providing stored actual values of degrees of refrigerant subcooling over a selected period of time during the charge-monitoring mode.

In the self-charging mode, the controller 40 provides output signals indicative of the degrees of subcooling which are displayed at the service panel 50 to enable the service technician to determine, in real-time, whether the system 10 has received the correct refrigerant charge, too little of a refrigerant charge, or too much of a refrigerant charge for the target degree of subcooling desired for the system 10. In one embodiment, the controller 40 is configured for autonomously controlling, without technician assistance, an external refrigerant canister (not shown) connected to the compressor 11 or to the refrigerant line 34 for automatically delivering the correct amount of refrigerant charge to the system 10 with minimal technician interaction. For example, the controller 40 may be configured to provide digital signals to the service panel 50 from a digital-to-analog converter 44, operatively associated with the microprocessor 42 and the service panel 50, indicative of the refrigerant charge in the system 10 based on various parameters known to the microprocessor 42. Specifically, the controller 40 provides the actual degrees of system subcooling SSC (derived from the discharge pressure $P_{Discharge}$ and the refrigerant liquid temperature $T_{Liquid}$) and compared to a system subcooling target. Alternately, the controller 40 provides the refrigerant liquid pressure $P_{Liquid}$, the refrigerant liquid temperature $T_{Liquid}$, the liquid saturation temperature $T_{Lsat}$ for the actual degrees of line subcooling LSC and compared to a liquid line subcooling target. In another embodiment, the controller 40 may assist the technician in delivering the correct refrigerant charge by receiving the technician's service tool at service panel 50. Additionally, the controller 40 is programmed to automatically disengage connection to the refrigerant canister (not shown) when the correct charge has been received. If the charge status is indicated as being low or high, the controller 40 autonomously takes the appropriate corrective action to adjust the level of refrigerant charge in the system 10 by either draining refrigerant from or adding refrigerant to the system 10. In another embodiment, the controller 40 provides inputs to assist the technician in delivering refrigerant or draining refrigerant.

Further, in an embodiment, the controller 40 may communicate with a charge status indicator panel 60 having a series of indicators, such as lights 62, 64 and 66, one of which is associated with an undercharge condition, one of which is associated with an over charge condition, and one of which is associated with a proper charge condition. The digital-to-analog converter 44 converts each of the received digital signals to a respective millivolt output signal and represents each millivolt signal on a respective tap 52 on the service panel 50 to provide the service technician information regarding the proper charge condition for system 10. In another embodiment, the service technician may use a conventional voltmeter to read the real-time value for the various output parameters, including the refrigerant discharge pressure $P_{Discharge}$, the refrigerant liquid temperature $T_{Liquid}$, the discharge saturation temperature $T_{Dsat}$, and the actual degrees of system subcooling SSC. Alternately, the service technician may use a conventional voltmeter to read the real-time value for the various output parameters, including the refrigerant discharge pressure $P_{Discharge}$, the refrigerant liquid temperature $T_{Liquid}$, the liquid saturation temperature $T_{Lsat}$, and the actual degrees of liquid line subcooling LSC. In another embodiment, the data may be processed and sent to a control unit or service tool digitally and displayed directly to the technician or home owner. In order to deliver the correct refrigerant charge to the system 10, the controller 40 is programmed to preset the system 10 to predetermined parameters including controlling the speed of the compressor 11, controlling the speed of the indoor fan speed 16 on the evaporator 14, and controlling the speed of the outdoor fan 18 on the condenser 12 prior to entry into the refrigerant self-charging mode. Also, the microprocessor 42 is programmed to enable refrigerant charging of the system 10 when environmental conditions are within acceptable ranges such as, for example, when the outdoor ambient temperature and the indoor ambient temperature is within a preset temperature range, the indoor humidity is within an acceptable range, and the outdoor coil is not wet so as to accurately deliver an accurate refrigerant charge to the system 10. In an embodiment, the preset outdoor ambient temperature range is about 60 degree Fahrenheit to about 105 degree Fahrenheit.

In the charge-monitoring mode, the controller 40 continuously monitors the refrigerant charge in the system 10 and is programmed for integrating the stored actual values of degrees of subcooling over a selected period of time to provide an average amount of subcooling over that selected time period and measured against a target degree of subcooling desired for the system 10. As the ambient operating conditions, e.g. outdoor temperature, outdoor humidity, indoor temperature and indoor humidity, etc. change, the amount of subcooling present at any given time during operation of the system 10 will vary over time. If these operating conditions vary widely, the amount of subcooling experienced during operation of the system 10 will also vary over a wide range. Accordingly, in charge monitoring mode, the controller 40 provides output signals reflective of the system's 10 refrigerant charge adequacy over a preprogrammed period of time of operation of the system. In an embodiment, the controller 40 is programmed for configuring the system 10 to predetermined parameters (i.e., forcing the system to the predetermined operating conditions) including controlling the speed of the compressor 11, controlling the speed of the indoor fan 16 of the evaporator 14, and controlling the speed of the outdoor fan 18 of the condenser 12 prior to entry into the charge-monitoring mode. Also, the controller 40 is programmed to monitor the degrees of subcooling when the outdoor ambient temperature is within a preset temperature range. The controller 40 communicates with a charge status indicator panel 60 having a series of indicators, such as lights 62, 64 and 66, one of which is associated with an undercharge condition, one of which is associated with an over charge condition, and one of which is associated with a proper charge condition. In embodiments, the controller 40 may be programmed to calculate and store the actual degrees of subcooling present at periodic time intervals, for example at one-hour intervals, and then from those stored valves calculate an average value for the degrees of line and system subcooling over a selected period of operation, for example the last forty hours of operation. The information may be communicated to a central controller, similar to a thermostat, located inside the controlled space then displayed on demand to an owner or service technician.

The charge status indicator panel 60 provides a very convenient indication of refrigerant charge status to the service technician during periodic maintenance service of the system or during service calls. The charge status indicator panel also alerts the owner of the home or building with which the air conditioning system 10 is associated of a potential refrigerant charge problem so that the service technician may be summoned. In an embodiment, the microprocessor 42 will compare this calculated average value for the degrees of subcooling to an acceptable range for the degree of subcooling from a low threshold level, for example 10 degree Fahrenheit, to a high threshold level, for example 15 degree Fahrenheit. If the average value for the degrees of subcooling is below the low threshold level, the microprocessor 42 will cause the indicator light 62, other display such as an indoor visual display on the charge status indication panel 60 to illuminate thereby indicating that the refrigerant charge is too low. If the average value for the degrees of subcooling is above the high threshold level, the controller 40 will cause the indicator light 66 on the charge status indication panel 60 to illuminate thereby indicating that the refrigerant charge is excessive. However, if the average value for the degrees of subcooling lies within the range of values lying between the low threshold level and the high threshold value, the controller 40 will cause the indicator light 64 on the charge status indication panel 60 to illuminate thereby indicating that the refrigerant charge is acceptable. In an embodiment, the controller 40 provides a signal related to the level of refrigerant charge in the system 10, where the signal indicates whether to add the refrigerant charge to the system or to recover the refrigerant charge from the system The controller 40 may be programmed to keep a running average value for the degrees of subcooling over the selected time interval. For example, every time the controller 40 calculates a new real-time value for the degrees of subcooling based upon real-time measurements as hereinbefore described, the controller 40 will discard the oldest stored value, substitute this latest calculated value for the discarded value and recalculate the average value for the selected time period. In this manner, the characterization of the refrigerant charge level indicated on the charge status indication panel 60 will always be up-to-date and represent the refrigerant charge adequacy over the last specified hours (or period) of operation.

For a number of reasons, including human error, it is very difficult to charge a newly installed air conditioning system with the proper level of refrigerant charge. Thus, when initially charging a system, the controller 40 will control the charge deliver to the system upon installation with an amount of refrigerant that results in a value for the degrees of subcooling that falls within a tolerance of a target value for degrees of subcooling at the current operating conditions. After the system has operated for a number of hours at equal to or exceeding the cumulative number of hours of operation over which the controller 40 has been preprogrammed to base its calculation of an average value for degrees of subcooling upon, the controller 40 will then check the charge status indicated on the charge status indication panel 60

Figure 2:
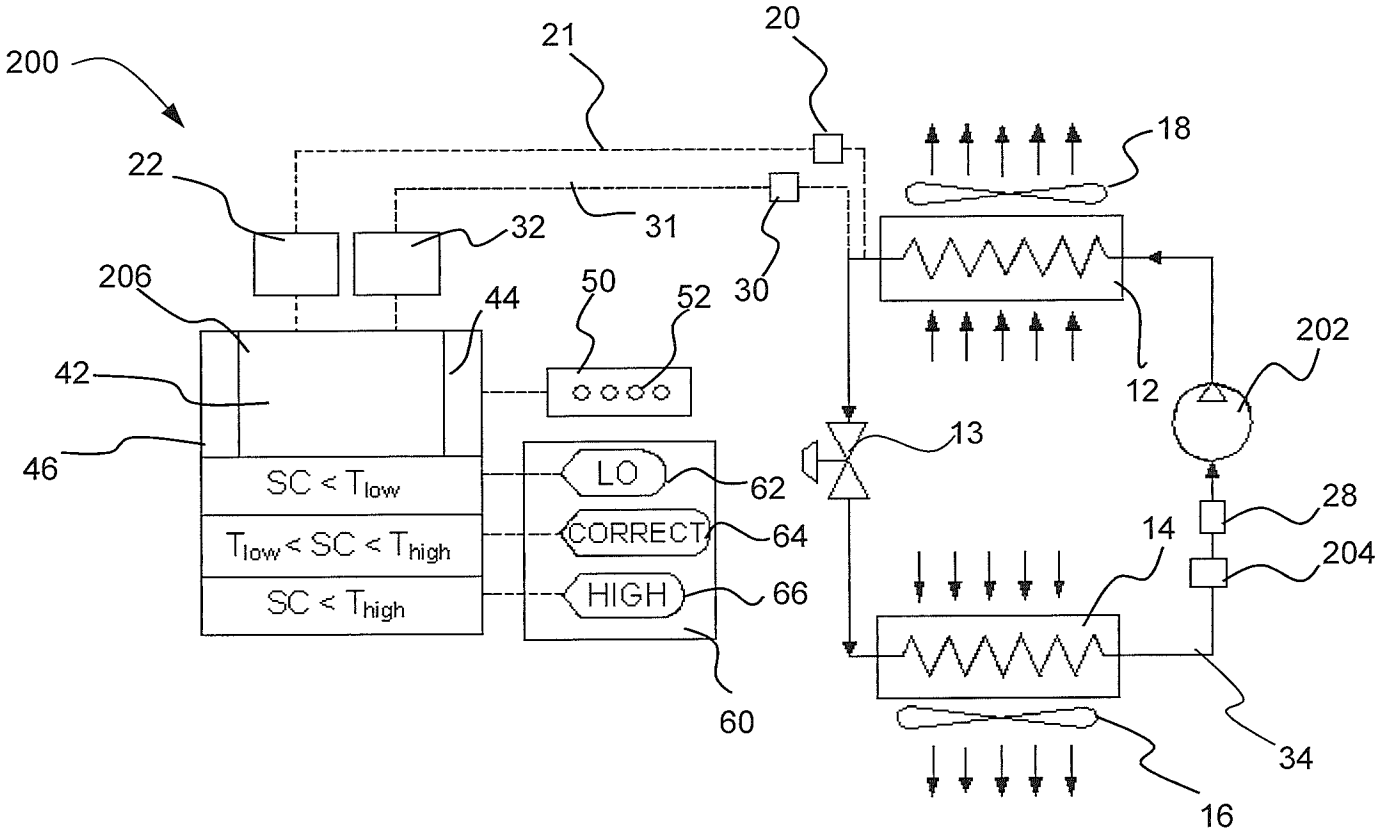
FIG. 2 illustrates a schematic view of an air-conditioning system including a controller and a non-variable speed compressor for implementing the self-charging and charge monitoring modes according to an embodiment of the invention.

In another embodiment, FIG. 2 illustrates a vapor compression system 200 having a compressor 202 integrated with a single speed non-inverter type motor 204 and coupled to a controller 206 for implementing the self-charging and charge monitoring modes of operation while all other aspects of vapor compression system 200 remain substantially the same as the vapor compression system 10 shown and described with reference to FIG. 1. Particularly, vapor compression system 200 includes a compressor 202 coupled to a non-inverter type motor 204 such as, for example, an AC motor or a permanent split capacitor (PSC) motor, an expansion device 13, an evaporator 12 connected in serial relationship in refrigerant flow communication in a conventional manner via refrigerant line 34 forming a refrigerant flow circuit. Also, sensors 30 and 28 operably connect the refrigerant line 34 to controller 206 in order to identify variables needed for charging the system 200 during refrigerant subcooling and for monitoring the charge level with respect to system subcooling SSC. Alternatively, in an embodiment, sensors 20 and 30 operably connect the refrigerant line 34 to controller 206 in order to identify variable needed for charging the system 200 during refrigerant subcooling and for monitoring the charge level with respect to liquid line subcooling LSC. The controller 206 includes a microprocessor 42 for executing instructions related to predicting the discharge pressure and liquid line subcooling or system subcooling needed for self-charging or charge monitoring in the system 200. In an embodiment, controller 206 executes algorithms for predicting the discharge pressure $P_{Discharge}$ for the compressor 202 from information received about current and voltage differential. The controller 206 stores data related to current and voltage differential in the motor or compressor 202, which is utilized to map to a compressor torque, which provides a differential pressure $P_{Differential}$ across the compressor 202. In an embodiment, the current, phase-angles and/or voltage differentials for the start (or secondary) and run (or primary) windings of the compressor motor (not shown) are stored in a memory device 46 in controller 206 and used to infer a compressor torque. Specifically, the current, phase-angle differential, and voltage differential between the start and run windings are mapped to a compressor torque, and subsequently to a pressure differential to estimate the discharge pressure $P_{Discharge}$. In another embodiment, other types of motors may be utilized in system 200 and currents obtained may be used to infer compressor torque for the compressor 202. In an embodiment, the controller 206 receives information regarding the suction pressure $P_{Suction}$ via a signal received by pressure sensor 28, which corresponds to a refrigerant pressure entering the suction port of the compressor 202, which is used to enhance the estimation of discharge pressure $P_{Discharge}$. It is to be appreciated that the discharge pressure $P_{Discharge}$ may be estimated from the compressor torque without utilizing a pressure sensor to directly provide a refrigerant pressure at the high side of the compressor 202, thereby providing for a more cost-efficient HVAC system 200.

In an embodiment, the microprocessor 42 is programmed to calculate the saturated discharge temperature $T_{Dsat}$ from the discharge pressure $P_{Discharge}$ by mapping values of $P_{Discharge}$ to $T_{Dsat}$. Alternately, the microprocessor 42 reads the saturated liquid temperature, $T_{Lsat}$ for the refrigerant in use at the measured pressure $P_{Liquid}$ from sensor 20. Knowing the saturated discharge temperature $T_{Dsat}$ or saturated liquid temperature $T_{Lsat}$, and the liquid line temperature $T_{Liquid}$, the microprocessor 42 calculates the actual degrees of either liquid line subcooling LSC or actual degrees of system subcooling SSC using equations (3) and (4) and stores the actual degrees of subcooling in the memory device 46.

$$LSC=T_{Lsat}-T_{Liquid}; \tag{3}$$

$$SSC=T_{Dsat}-T_{Liquid} \tag{4}$$

Additionally, the controller 206 communicates with a service panel 50 for providing real-time output to a service technician during the refrigerant self-charging mode and for providing stored actual values of degrees of subcooling over a selected period of time during the charge monitoring mode utilizing the calculated values of liquid line subcooling or system subcooling as was described above with reference to FIG. 1.

Figure 3:
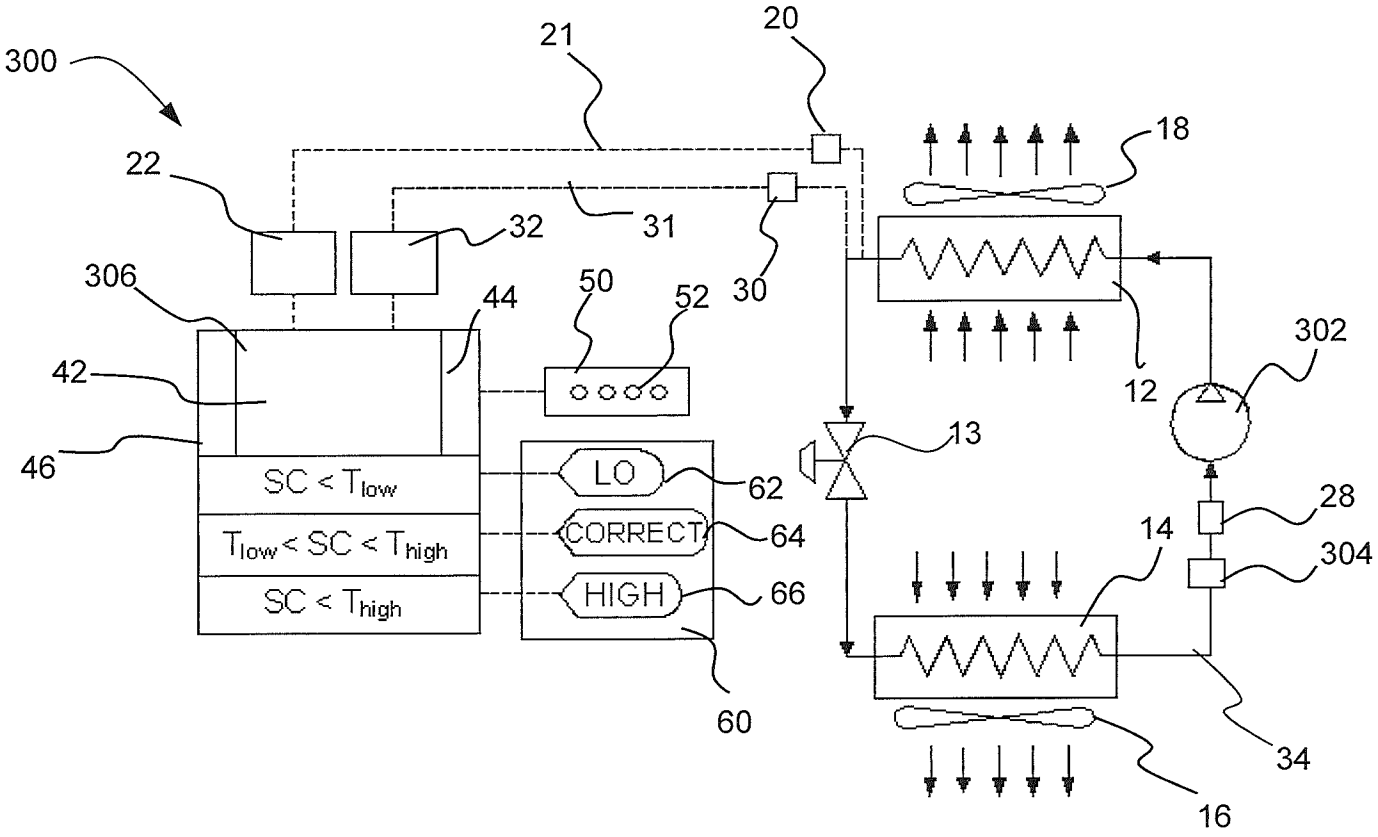
FIG. 3 illustrates a schematic view of an air-conditioning system including a controller and a non-variable speed compressor for implementing the self-charging and charge monitoring modes according to an embodiment of the invention.

In another embodiment, FIG. 3 illustrates a vapor compression system 300 having a compressor 302 integrated with a single speed non-inverter type motor 304 and coupled to a controller 306 for implementing the self-charging and charge monitoring modes of operation while all other aspects of vapor compression system 300 remain substantially the same as the vapor compression system 10 shown and described with reference to FIGS. 1 and 2. Particularly, vapor compression system 300 includes a compressor 302 coupled to a non-inverter type motor 304 such as, for example, an AC motor or a permanent split capacitor (PSC) motor, an expansion device 13, an evaporator 12 connected in serial relationship in refrigerant flow communication in a conventional manner via refrigerant line 34 forming a refrigerant flow circuit. Also, sensors 20 and 30 operably connect the refrigerant line 34 to controller 306 in order to identify variable needed for charging the system 300 during refrigerant subcooling and for monitoring the charge level with respect to refrigerant subcooling. The controller 306 includes a microprocessor 42 for executing instructions related to predicting liquid line subcooling needed for self-charging or charge monitoring in the system 70, as shown in equation (5) and stores the actual degrees of subcooling in the memory device 46:

$$LSC=T_{Lsat}-T_{Liquid} \quad (5)$$

The technical effects and benefits of embodiments relate to a refrigerant vapor compression system including a controller for facilitate the charging of the system in a "self-charging" mode and to periodically monitor the refrigerant charge in the system in a "charge monitoring" mode.

The terminology used herein is for the purpose of describing particular embodiments only and is not intended to be limiting of the invention. While the description of the present invention has been presented for purposes of illustration and description, it is not intended to be exhaustive or limited to the invention in the form disclosed. Many modifications, variations, alterations, substitutions, or equivalent arrangement not hereto described will be apparent to those of ordinary skill in the art without departing from the scope and spirit of the invention. Additionally, while various embodiment of the invention have been described, it is to be understood that aspects of the invention may include only some of the described embodiments. Accordingly, the invention is not to be seen as limited by the foregoing description, but is only limited by the scope of the appended claims.

The invention claimed is:

1. A method for determining a level of refrigerant charge in a vapor compression system including a compressor, a condenser, an expansion device and an evaporator operatively connected in serial relationship in a refrigerant flow circuit having a refrigerant, comprising:

receiving information indicative of at least one of a compressor torque or compressor current;

determining a value for a degree of refrigerant subcooling for the system from the received information, wherein determining the value for the degree of refrigerant subcooling includes presetting at least one system variable prior to the determining of the value for the degree of subcooling, wherein the presetting of the at least one system variable further comprises controlling a first speed of an evaporator fan associated with the evaporator, a second speed of a condenser fan associated with the condenser, and controlling a compressor speed of the compressor; and determining whether the refrigerant charge is within a defined tolerance or whether the refrigerant is to be added or recovered in response to the degree of refrigerant subcooling.

2. The method of claim 1, further comprising determining a discharge pressure from the received information.

3. The method of claim 2, wherein determining a value for a degree of refrigerant subcooling for the system is additionally based on a discharge pressure of the compressor.

4. The method of claim 1 further comprising automatically carrying out at least one of adding the refrigerant to the system and recovering the refrigerant from the system based on a comparison of the degree of refrigerant subcooling with a target degree of subcooling.

5. The method of claim 1, further comprising manually receiving the refrigerant in the system or manually recovering the refrigerant from the system based on a comparison of the value with a target degree of subcooling.

6. The method of claim 1, further comprising automatically carrying out at least one of adding the refrigerant to the system and recovering the refrigerant from the system in response to commissioning of the vapor compression system.

7. The method of claim 1, further comprising determining a target degree of subcooling as a function of at least one of indoor coil size, indoor relative humidity, indoor temperature, indoor air flow, lineset length, outdoor temperature, outdoor fan revolutions per minute, and revolutions per minute of the compressor.

8. The method of claim 1, further comprising receiving a sensor signal corresponding to a suction pressure of the compressor.

9. The method of claim 8, further comprising determining a discharge pressure by mapping each of compressor torque, compressor speed, and the suction pressure to a compressor discharge pressure.

10. The method of claim 1, further comprising automatically delivering a correct amount of the refrigerant charge to the system via an external refrigeration source.

11. The method of claim 1, further comprising receiving electric power data from a motor coupled to the compressor, the electric power data including data regarding a voltage differential, a current, and a phase-angle differential of the motor.

12. The method of claim 1, further comprising modulating electric power delivered to a variable speed motor coupled to the compressor.

13. The method of claim 1, further comprising receiving information regarding a liquid line pressure and liquid line temperature of the refrigerant.

14. The method of claim 13, further comprising mapping the discharge pressure to a saturated discharge temperature.

15. The method of claim 14, further comprising calculating a degree of system subcooling based on the saturated discharge temperature and the liquid line temperature.

16. The method of claim 13, further comprising calculating a degree of liquid line subcooling based on the liquid line pressure and the liquid line temperature.

17. The method of claim 1, further comprising providing a signal related to the level of the refrigerant charge in the system, the signal indicative of a need to add the refrigerant to the system or to recover the refrigerant from the system.

18. A method for determining a level of refrigerant charge in a vapor compression system including a compressor, a condenser, an expansion device and an evaporator operatively connected in serial relationship in a refrigerant flow circuit having a refrigerant, comprising:

receiving information indicative of at least one of a compressor torque or compressor current;

determining a value for a degree of refrigerant subcooling for the system from the received information, wherein determining the value for the degree of refrigerant subcooling includes presetting at least one system variable prior to the determining of the value for the degree of subcooling, wherein the presetting of the at least one system variable further comprises controlling a first speed of an evaporator fan associated with the evaporator, a second speed of a condenser fan associated with the condenser, and controlling a compressor speed of the compressor; and determining whether the refrigerant charge is within a defined tolerance or whether the refrigerant is to be added or recovered in response to the degree of refrigerant subcooling;

comparing the value for the degree of refrigerant subcooling with a target degree of refrigerant subcooling;

outputting an electrical signal indicative of the real-time value for the degree of refrigerant subcooling present;

updating an average value of the degree of refrigerant subcooling for a preselected time period of system operation by discarding a stored degree of refrigerant subcooling and using the real-time value for the degree of refrigerant subcooling present to calculate an updated average value of the degree of refrigerant subcooling;

outputting the level of the refrigerant charge for the preselected time period of system operation; and automatically carrying out at least one of adding the refrigerant to the system and recovering the refrigerant from the system based on a comparison of the degree of refrigerant subcooling with a target degree of subcooling.

19. A method for determining a level of refrigerant charge in a vapor compression system including a compressor, a condenser, an expansion device and an evaporator operatively connected in serial relationship in a refrigerant flow circuit having a refrigerant, comprising:

receiving information indicative of at least one of a compressor torque or compressor current;

determining a value for a degree of refrigerant subcooling for the system from the received information, wherein determining the value for the degree of refrigerant subcooling includes presetting at least one system variable prior to the determining of the value for the degree of subcooling, wherein the presetting of the at least one system variable further comprises controlling at least one of a first speed of an evaporator fan associated with the evaporator, a second speed of a condenser fan associated with the condenser, and controlling a compressor speed of the compressor, wherein determining the value for the degree of refrigerant subcooling based on at least the compressor torque; and determining whether the refrigerant charge is within a defined tolerance or whether the refrigerant is to be added or recovered in response to the degree of refrigerant subcooling;

comparing the value for the degree of refrigerant subcooling with a target degree of refrigerant subcooling;

outputting an electrical signal indicative of the real-time value for the degree of refrigerant subcooling present;

updating an average value of the degree of refrigerant subcooling for a preselected time period of system operation by discarding a stored degree of refrigerant subcooling and using the real-time value for the degree of refrigerant subcooling present to calculate an updated average value of the degree of refrigerant subcooling;

outputting the level of the refrigerant charge for the preselected time period of system operation; and automatically carrying out at least one of adding the refrigerant to the system and recovering the refrigerant from the system based on a comparison of the degree of refrigerant subcooling with a target degree of subcooling.

20. The method of claim 18, wherein determining the value for degree of refrigerant subcooling is additionally based upon a discharge pressure of the compressor.

21. The method of claim 18, further comprising receiving a sensor signal corresponding to a suction pressure of the compressor.

22. The method of claim 20, further comprising determining the discharge pressure by mapping each of compressor torque, compressor speed, and a suction pressure to the discharge pressure.

23. The method of claim 18, further comprising receiving electric power data from a motor coupled to the compressor, the electric power data including data regarding at least one of a voltage differential, a current, and a phase-angle differential of the motor.

24. The method of claim 18, further comprising receiving data from an inverter drive coupled to a variable speed motor, the variable speed motor being coupled to the compressor.

25. The method of claim 24, further comprising modulating a speed of the variable speed motor with the inverter drive, wherein the inverter drive is configured to modulate electric power delivered to the variable speed motor.

26. The method of claim 18, further comprising receiving information regarding liquid line pressure and liquid line temperature of a refrigerant.

27. The method of claim 26, further comprising mapping the discharge pressure to a saturated discharge temperature of the refrigerant.

28. The method of claim 26, wherein the calculating of the value for the degree of refrigerant subcooling further comprises calculating a degree of system subcooling based on the saturated discharge temperature and liquid line temperature of the refrigerant.

29. The method of claim 26, wherein the calculating of the value for the degree of refrigerant subcooling further comprises calculating a degree of liquid line subcooling based on the liquid line pressure and the liquid line temperature.

30. A method for determining a level of refrigerant charge in a vapor compression system including a compressor, a condenser, an expansion device and an evaporator operatively connected in serial relationship in a refrigerant flow circuit having a refrigerant, comprising:

receiving information indicative of a compressor torque;

determining a value for a degree of refrigerant subcooling for the system from the compressor torque, wherein determining the value for the degree of refrigerant subcooling includes presetting at least one system variable prior to the determining of the value for the degree of subcooling, wherein the presetting of the at least one system variable further comprises controlling at least one of a first speed of an evaporator fan associated with the evaporator, a second speed of a condenser fan associated with the condenser, and controlling a compressor speed of the compressor; and determining whether the refrigerant charge is within a defined tolerance or whether the refrigerant is to be added or recovered in response to the degree of refrigerant subcooling.

* * * * *